US007938162B2

(12) United States Patent
Duineveld

(10) Patent No.: US 7,938,162 B2
(45) Date of Patent: May 10, 2011

(54) ROLLER BLIND AND ASSEMBLY COMPRISING A ROLLER BLIND OF THIS TYPE AND DOUBLE GLAZING UNIT

(76) Inventor: Martinus Laurentius Jozef Duineveld, Zevenhuizen (NL)

( * ) Notice: Subject to any disclaimer, the term of this patent is extended or adjusted under 35 U.S.C. 154(b) by 247 days.

(21) Appl. No.: 12/146,949

(22) Filed: Jun. 26, 2008

(65) Prior Publication Data

US 2009/0159218 A1 Jun. 25, 2009

(30) Foreign Application Priority Data

Jun. 27, 2007 (NL) ..... 2000725

(51) Int. Cl.
*E06B 9/08* (2006.01)
*E06B 3/32* (2006.01)
*E06B 7/16* (2006.01)

(52) U.S. Cl. ..... 160/121.1; 160/98; 160/41

(58) Field of Classification Search ..... 160/121.1, 160/120, 41, 98, 85, 86, 179
See application file for complete search history.

(56) References Cited

U.S. PATENT DOCUMENTS 842,968 A * 2/1907 McCloud ..... 160/1
2,328,257 A * 8/1943 Butts ..... 160/121.1
4,039,019 A * 8/1977 Hopper ..... 160/121.1
4,187,896 A * 2/1980 Shore ..... 160/121.1
4,194,550 A * 3/1980 Hopper ..... 160/121.1
4,313,484 A * 2/1982 Shore ..... 160/121.1
4,344,473 A * 8/1982 Shore ..... 160/121.1
4,344,474 A * 8/1982 Berman ..... 160/121.1
4,433,712 A * 2/1984 Mellon et al. ..... 160/122
4,453,584 A * 6/1984 Steele ..... 160/121.1
5,168,647 A * 12/1992 Castro ..... 40/518
5,392,549 A * 2/1995 Castro ..... 40/518
5,538,065 A * 7/1996 G eraud ..... 160/85
6,651,720 B1 11/2003 DiSilvestro et al.
7,201,205 B2 * 4/2007 Lyness et al. ..... 160/107
7,281,561 B2 * 10/2007 Anderson et al. ..... 160/121.1
2005/0287295 A1 * 12/2005 Papp ..... 427/248.1

FOREIGN PATENT DOCUMENTS

FR 2398170 2/1979
GB 1586801 3/1981

* cited by examiner

*Primary Examiner* — Blair M Johnson
*Assistant Examiner* — Jaime F Cardenas-Garcia
(74) *Attorney, Agent, or Firm* — The Webb Law Firm

(57) ABSTRACT

The invention relates to a roller blind having at least four layers. The outer layers form one sheet and the inner layers form one sheet. A cylindrical body is provided in the inner sheet. The outer sheet has a bending stiffness which is such that, at least at the location of the cylindrical body between the layers of the outer sheet and the layers of the inner sheet, a distance is maintained. The invention furthermore relates to an assembly of a roller blind according to the invention and a double glazing unit.

9 Claims, 3 Drawing Sheets

ROLLER BLIND AND ASSEMBLY COMPRISING A ROLLER BLIND OF THIS TYPE AND DOUBLE GLAZING UNIT

BACKGROUND OF THE INVENTION

1. Field of the Invention

The present invention relates to a roller blind to be used in buildings and having heat insulating properties.

2. Description Prior Art

A roller blind is known from U.S. Pat. No. 4,433,712 wherein two flexible sheets are provided, an inner sheet and an outer sheet, which each form two layers in the lowered position in order to provide, in this manner, insulating air spaces between said layers. In the first sheet, a cylindrical weight is provided in an unattached manner—i.e. not fixed to said sheet—and, in a corresponding manner, a cylindrical weight is provided in the outer sheet.

SUMMARY OF THE INVENTION

The present invention aims to provide an improved roller blind having in the lower position of the roller blind at least four layers.

According to a first aspect of the invention a roller blind is provided comprising in the lowered position of the roller blind, four layers; with the two outer layers forming one outer sheet and the other two layers forming one inner sheet;

with an elongate body being provided in the inner sheet in an unattached manner;

with the inner sheet and outer sheet each being attached to a winding reel by a first width edge so that they can be unwound from the winding reel and wound onto the winding reel; and with the inner sheet at least in the lowered position of the roller blind, being inside the outer sheet;

with the bending stiffness of the inner sheet being such that the horizontal distance between the layers of the inner sheet, at the elongate body, corresponds to the thickness of the elongate body, viewed in the horizontal direction; wherein the outer sheet is not provided with a weight and has a bending stiffness which is greater than the bending stiffness of the inner sheet; and wherein the bending stiffness of the outer sheet is such that said bending stiffness maintains a distance between the layers of the outer sheet which is greater than the thickness of the elongate body in such a manner that the layers of the outer sheet are at a distance from the layers of the inner sheet.

According to this aspect of the invention the bending stiffness of the outer sheet is greater than the bending stiffness of the inner sheet and such that the bending stiffness, at least at the location of the elongate body, maintains a distance between the layers of the outer sheet which is greater than the thickness of the elongate body. With the roller blind according to the present invention, one single weight, referred to as an elongate body, which is provided in the inner sheet in an unattached manner is sufficient. Therefore, the second weight which is provided in the outer sheet of the prior art is thus redundant in the roller blind according to this aspect of the invention. In the absence of such a second elongate body, or second weight, the outer side of the inner sheet can lie on the inside of the outer sheet at the bottom side of the lowered roller blind when the roller blind is lowered completely. Thus, a roller blind is achieved which performs more efficiently and, in addition, has very good insulating properties with respect to heat and/or cold due to the intermediate spaces between the plurality of layers.

According to a further aspect it is particularly advantageous if the bending stiffness of the outer sheet is such that the distance between the layers of the outer sheet is approximately equal to or greater than the diameter of the winding reel. Thus, it is possible to ensure, in a simple manner, that the layers of the outer sheet, in the lowered position of the roller blind, are approximately parallel with one another across the entire vertical height of the roller blind. In particular, this distance is at most 20 mm, more in particular at most 15 mm, more particularly at most 10 mm, greater than the diameter of the winding reel. Thus, the outer sheet, the end thereof which is not attached to the winding reel, can lie next to or above the winding reel, viewed in the vertical height direction, without coming into contact with the sheets wound onto the winding reel. At the same time, the installation width, viewed in the horizontal direction, at the winding reel, can be kept relatively small.

According to a further aspect, the outer and inner sheet each have a second width edge which runs parallel to the first width edge, the outer sheet and the inner sheet are each, at the second width edge, supported on a fixed supporting point, and the fixed supporting point of the outer sheet and the fixed supporting point of the inner sheet are at a horizontal distance from one another and, when the roller blind is completely unwound, viewed in the vertical direction, higher than the elongate body. In this case, it is particularly advantageous if the first width edge of the inner sheet and the first width edge of the outer sheet are attached to the winding reel at locations which, in the circumferential direction of the winding reel, are at a distance from one another. The result of this is that, when the roller blind is unwound completely, the layers of the inner and the outer sheet attached to the winding reel are automatically at a horizontal distance apart without requiring a separate guide element.

In a further embodiment the horizontal distance between the fixed supporting point of the outer sheet and the fixed supporting point of the inner sheet is approximately equal to the horizontal distance between the attachment location of the inner sheet to the winding reel and the location where the outer sheet comes off the winding reel, when the inner sheet is completely unwound from the winding reel. The result of this is that, when the roller blind is completely unwound, the horizontal distance between the layers of the inner and outer sheets facing one another is approximately equal on both sides.

According to a further embodiment, the roller blind comprises more than two sheets which, in the unwound position, have two layers running parallel with one another, and which are all inside one another, with the bending stiffness of the sheets in each case increasing from the inner to the outer sheet. Thus, the number of intermediate spaces between the various layers can be increased, which improves the heat/cold-insulating effect.

According to yet another, further embodiment, the roller blind comprises one or more single-layer sheets which are attached to the winding reel by a first width edge and, in the unwound position, are suspended freely from a second width edge which runs parallel to the first width edge. Thus, the space between two layers of one or two multi-layer sheets can easily be divided in two or subdivided further, which improves the insulating effect.

According to a further embodiment, the roller blind comprises a motor which is connected to the winding reel in a driving manner for winding and unwinding the winding reel. Thus, the roller blind can be operated electrically. In order to minimize the required installation space, it is advantageous in this case if the motor is accommodated in the winding reel. Despite the fact that the motor is accommodated in the winding reel, it can in this case be attached to the environment. In order to prevent the roller blind from jolting and getting stuck, it is advantageous, in this case, if the motor shaft of the motor is connected to the winding reel by means of a flexible coupling, in particular a sound-insulating flexible coupling.

According to a further embodiment, the elongate body is a cylindrical body.

According to a further aspect one or more sheets may be provided with a heat-reflecting layer on one or both sides. This can for example be realised with an aluminised polyester foil.

According to a still further aspect, the present invention relates to an assembly comprising a roller blind as described above, as well as a double glazing unit which defines a glazing cavity, in which the roller blind is provided inside the glazing cavity. Arranging the roller blind inside the glazing cavity of a double glazing unit ensures that the roller blind can at all times be wound and unwound in an unimpeded way. In addition, this significantly improves the insulating effect as the air or other gas which is present in the glazing cavity of the double glazing unit will not be moved by external draught, or at least to a lesser extent, since the glazing cavity forms a protected space. In order to reinforce this effect, it is, in addition, advantageous if the glazing cavity is sealed in an air-tight and dampproof manner. Thus, the possibility of external draught moving the gas/air inside the glazing cavity can be ruled out completely.

According to an embodiment of the invention, the edge of the glazing cavity extending in the circumferential direction of the glazing unit may be made of glass.

According to a further embodiment the glazing cavity is filled with a gas which has a lower thermal conduction coefficient than air.

According to a further aspect of the invention, a moisture-absorbing desiccant is provided in the winding reel and if the winding reel is provided with passages which are covered by a vapour-permeable layer. If there is moisture inside the glazing cavity, this can then be absorbed by the absorbing desiccant. Such absorbing desiccants are generally known in the art, an example thereof being silica gel. In addition or instead thereof it is advantageous, according to the invention, if a moisture-absorbing desiccant is provided in the elongate body and if the elongate body is provided with passages which are covered by a vapour-permeable layer. In order to prevent the formation of condensation inside the glazing cavity as much as possible, it is advantageous if the sheets are predried before being placed in the glazing cavity.

According to a further aspect of the invention the outer layer of the outer sheet provided at the outer pane of the double glazing unit, in the unwound position, is situated at a distance of less than 10 mm, such as 5 mm or less, from the outer pane. This is particularly important with regard to the reflective properties under in particular summary conditions. During sunny weather, the outer layer of the outer sheet turned towards the outer pane will become very hot. The dissipation of heat to the outside of the building via the outer pane will improve as the thickness of the layer of stationary air between the outer pane and the outer layer of the outer sheet becomes smaller. The distance between the outer pane of the double glazing unit and the outer layer of the outer sheet turned towards the latter will preferably be as small as possible. From this point of view, the outer layer of the outer sheet turned towards the outer pane will preferably rest against or almost against the outer pane. In order to prevent wear of the outer layer of the outer sheet turned towards the outer pane and of the outer pane, the distance between them will be greater than 0 mm. Preferably, the distance between the outer pane and the outer layer of the outer sheet turned towards the outer pane will be between 0 and 3 mm.

According to an embodiment of the invention, the lower edge of the glazing cavity is provided with a reflective surface turned towards the glazing cavity. Thus, it is possible to achieve a good light yield inside the building during sunny weather with the roller blind almost completely lowered, as sunlight will then be reflected and passed into the building via the lower edge of the glazing cavity. If the sunlight is reflected by a ceiling with a light colour, the need for artificial light will be significantly reduced.

Both the second width edges of the sheets which, in the unwound position, have two layers and the winding reel are preferably provided along the upper edge of the double glazing unit and one or more flaps are provided along said upper edge which prevent the flow of air along the upper side of the winding reel. The result thereof is that the layers of air in the intermediate spaces between the layers of the sheets remain stationary as much as possible.

According to a further embodiment of the invention the upper edge of the glazing cavity is provided with a first ventilation duct and a second ventilation duct, with the outer ends of both ventilation ducts ending outside the assembly, with an inner end of the first ventilation duct ending in the space between the outer pane and the outer layer of the outer sheet, and with an inner end of the second ventilation duct ending in the space between the inner pane and the inner layer of the outer sheet. Thus, a good ventilation is achieved under all weather conditions. When it is cold outside, the second ventilation duct will act as an outlet and the first ventilation duct as an inlet, and when it is sunny, the first ventilation duct will act as an outlet and the second ventilation duct as an inlet. In order to keep insects and/or dust particles out, it is furthermore advantageous according to the invention if both ventilation ducts are provided with an insect screen and/or an air filter. In order to prevent the ventilation ducts from affecting one another, it is advantageous if the outer ends of the ventilation ducts end at a horizontal distance apart of at least 1 to 2 cm.

The bending stiffness of the inner sheet has to be understood as being the bending stiffness of the inner sheet material as such and/or the combination with the weight, such as a tube, which is inserted therein. The bending stiffness of the outer sheet comprises only the material properties of the outer sheet as such because according to the invention a weight is not provided.

BRIEF DESCRIPTION OF THE DRAWINGS

The present invention will be described in more detail below with reference to an example which is diagrammatically illustrated in the drawing, in which.

DETAILED DESCRIPTION OF THE PREFERRED EMBODIMENTS

Figure 1A:
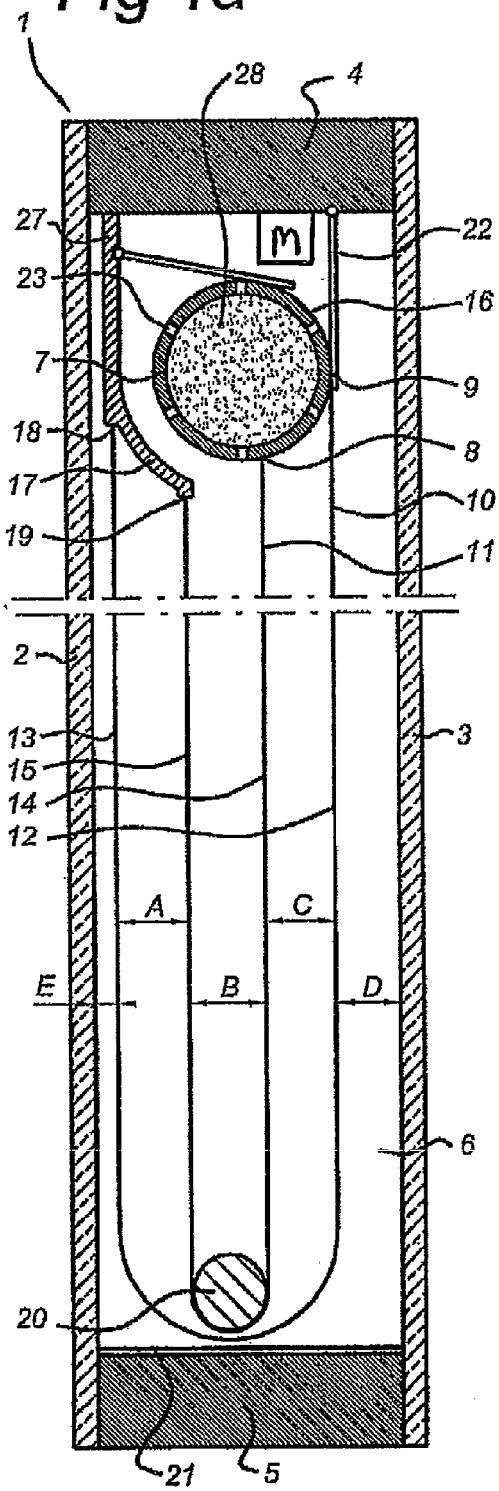
FIG. 1*a* shows a vertical cross section of a roller blind according to a first embodiment of the invention, in which the roller blind is in the completely lowered position.
Figure 1B:
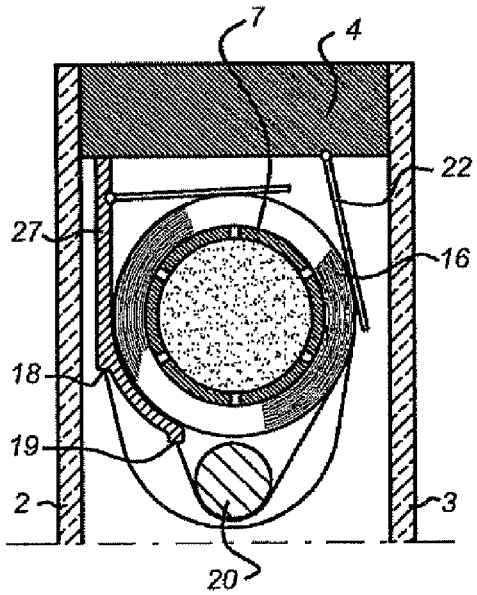
FIG. 1*b* shows a vertical cross-section of the roller blind according to the first embodiment of the invention, in which the roller blind is in the completely raised position.

FIGS. 1*a* and 1*b* show a vertical cross section of a double glazing unit 1 with an outer pane 2 and inner pane 3, between which a glazing cavity 6 is situated. The glazing cavity 6 is completely closed by the outer pane 2 and the inner pane 3 as well as a border. Only the upper edge 4 and the lower edge 5 of the border can be seen in FIG. 1*a*.

Although the border 4, 5 of the glazing cavity 6 may be made of any material which is known from the prior art in the field of double glazing for this purpose, it is preferable according to the invention to make said border from a material with a low thermal conduction coefficient. This prevents thermal conduction from the outer pane to the inner pane and vice versa via the border of the glazing cavity as much as possible. In this connection, it is advantageous according to the invention to make the border of the glazing cavity 6 from glass. Glass has a relatively low thermal conduction coefficient.

In order to improve the heat-insulating effect, it is furthermore advantageous if the glazing cavity is filled with a gas, the thermal conduction coefficient of which is lower than that of air and/or the viscosity of which is lower than that of air. A low thermal conduction coefficient has the advantage that the gas in the glazing cavity conducts the heat less well. A high viscosity of the gas in the glazing cavity has the advantage that said gas will be moved less easily on account of heat effects. This is particularly important as, with the roller blind according to the invention, several vertical layers of air are formed in the glazing cavity which should be prevented from mixing with one another as much as possible. At the top of the glazing cavity, a horizontally arranged winding reel 7 is fixedly suspended. On said winding reel, an outer sheet 10 is attached to an inner sheet 11. At 8, the inner sheet 11 is fixedly attached by a first width edge to the winding reel 7. At 16, the outer sheet 12 is fixedly attached to the winding reel 7 by its first width edge. At 9, the outer sheet 12 comes off the winding reel 7. Referring to FIG. 1*a*, it will be clear that the first width edge of the outer sheet 12 can also be attached to the winding reel 7 at the release point 9.

As can be seen in FIG. 1*a*, the outer sheet 10 has two layers 12 and 13, with layer 12 being situated near the inner pane 3 and layer 13 being situated near the outer pane 2. In a similar manner, the inner sheet 11 also has two layers 14 and 15, with layer 14 being situated closest to the inner pane 3 and the layer 15 being situated closest to the outer pane 2.

At the top of the glazing cavity 6, a suspended vertical partition 27 is provided which, at 18, passes into a partition 17 which is curved in the shape of an arc of a circle. The outer sheet 10 has a second width edge, which is attached to the partition 16 at 18 and extends parallel to the first width edge, which is attached to the winding reel at 16. In a similar manner, the inner sheet 11 has a second width edge, which, at 19, is attached to the lower end of the partition 17 which is curved in the shape of an arc of a circle and extends parallel to the first width edge, which is attached to the winding reel at 8.

The horizontal distance between attachment location 18 and attachment location 19 is such that the horizontal distance between the outwardly turned layer 13 of the outer sheet and the outwardly turned layer 15 of the inner sheet equals A. A may, for example, be 1 to 2 cm. In the completely lowered position of the roller blind, the horizontal distance between the attachment point 8 of the inner sheet 11 on the winding reel 7 and the release point 9, where the outer sheet 10 comes off the winding reel 7, has a value C. Preferably, the distance C is approximately equal to the distance A.

Inside the inner sheet 1, an elongate body, in particular a cylindrical body 20, is provided. Said body 20 is arranged in the central sheet in an unattached manner. The expression 'in an unattached manner' is in this context understood to mean that the body 20 is not attached to the inner sheet 11, but rather lies loose.

When the roller blind is lowered from the raised position illustrated in FIG. 1*b* by unwinding the winding reel 7, the body 20 will sink down and ensure that the inner sheet 11 is unwound in the form of two parallel layers 14, 15. The layers 14, 15 of the inner sheet 11 will in this case be a horizontal distance B apart. Said horizontal distance B is approximately equal to the diameter of the body 20. The result of choosing the diameter of the body 20 to be equal not only to the horizontal distance between the attachment location 18 and attachment location 19 but also equal to the horizontal distance C between the attachment location 8 in the completely lowered position of the roller blind and the release point 9, is that the distances A, B and C are approximately equal to one another. The horizontal distance D of the layer 12 of the outer sheet 10, which layer 12 is situated closest to the inside, to the inner pane 3 depends on the diameter of the winding reel 7, the width of the glazing cavity 6 and the positioning of the winding reel 7 in said glazing cavity. Said distance D may be of the same order of magnitude as the distances A, B and C, but may also be significantly smaller. If the distance between two layers is too great, the heat-insulating effect decreases. A distance of 15 to 16 mm has been found to produce optimum results in respect of the heat-insulating effect. However, the complete assembly of layers and inner pane and outer pane then becomes quite thick. It is therefore preferable to choose a smaller distance between the layers. If the following values are chosen: for A, B, C and D approximately 10 mm, for the glass thickness 4 to 5 mm and for E 1 to 2 mm, it is possible to achieve a thickness of the assembly of approximately 50 mm following the embodiment according to FIGS. 1*a* and 1*b*. By reducing in particular A, B, C and D, the thickness of the assembly can be reduced further, for example to approximately 30 mm, if A, B, C and D are each approximately 5 mm.

The distance E between the outer pane 2 and layer 13 of the outer sheet 10, which layer 13 is situated farthest to the outside, is preferably as small as possible and most preferably 0 or at least almost 0. If said distance is 0, the layer 13 will lie against the outer pane 2. This has the advantage that if said layer 13 becomes very hot on account of the sun, the heat can easily be passed on to the outer pane 2 and be dissipated to the environment via the outer pane 2. Thus, the build-up of heat inside the glazing cavity 6 is prevented. If the layer 13 does not contact the outer pane 2, but is just next to it, the distance E will preferably be kept as small as possible in order, when the layer 13 becomes hot, to be able to radiate the heat to the outer pane 2 relatively easily and to dissipate the heat via the outer pane 2 to the environment.

The bending stiffness of the inner sheet 11 is so small that the latter automatically covers the body 20 over a curve angle of 180° on the bottom side at all times. According to the invention, the bending stiffness of the outer sheet 10 is exactly of such a magnitude that the latter does not enclose the body 20 over 180°, but just maintains a distance between the layers 13 and 12 of the outer sheet, at the location of the body 20, which is such that the layers 12 and 13 of the outer sheet are each at a distance from the layers 14 and 15, respectively, of the inner sheet 11 which are turned towards said outer sheet.

By providing that, viewed at right angles to the plane of the drawing, the outer sheet 10 and inner sheet 11 extend from the one vertical edge (not shown) of the border of the glazing cavity 6 to the other vertical edge (not shown) of the border of the glazing cavity 6, it is ensured that the spaces between the layers 13 and 15, the layers 15 and 14, and the layers 14 and 12 are substantially closed. If desired, this closure may be improved by means of sealing strips, such as those which are also known, for example, from U.S. Pat. No. 4,433,712, (see for example sealing strips 74 and 72 on frame strips 61 in said document). The partitions 16 and 17 will for this reason, viewed at right angles to the plane of the drawing, also extend from the one vertical edge (not shown) as far as against the other vertical edge (not shown) of the border of the glazing cavity 6. In order to close the connection between the space between the layers 15 and 14 and the space between the layer 10 and the inner pane 3, it is advantageous according to the invention if a flexible flap 22 is provided, which is attached to the upper edge 4 of the border of the glazing cavity and which bears against the winding reel 7 by the action of spring force.

In order to prevent the formation of condensation in the glazing cavity 6 to a large degree, it is advantageous according to the invention if a moisture-absorbing agent 28, such as silica gel, is provided in the interior of the winding reel 7 and/or in the interior of the body 20, and if the winding reel 7 and/or the body 20 is provided with passages 23 closed off by a moisture-permeable membrane.

Referring again to FIG. 1*a*, a motor M is accommodated in the glazing unit 1 for winding and unwinding the winding reel 7.

Figure 2:
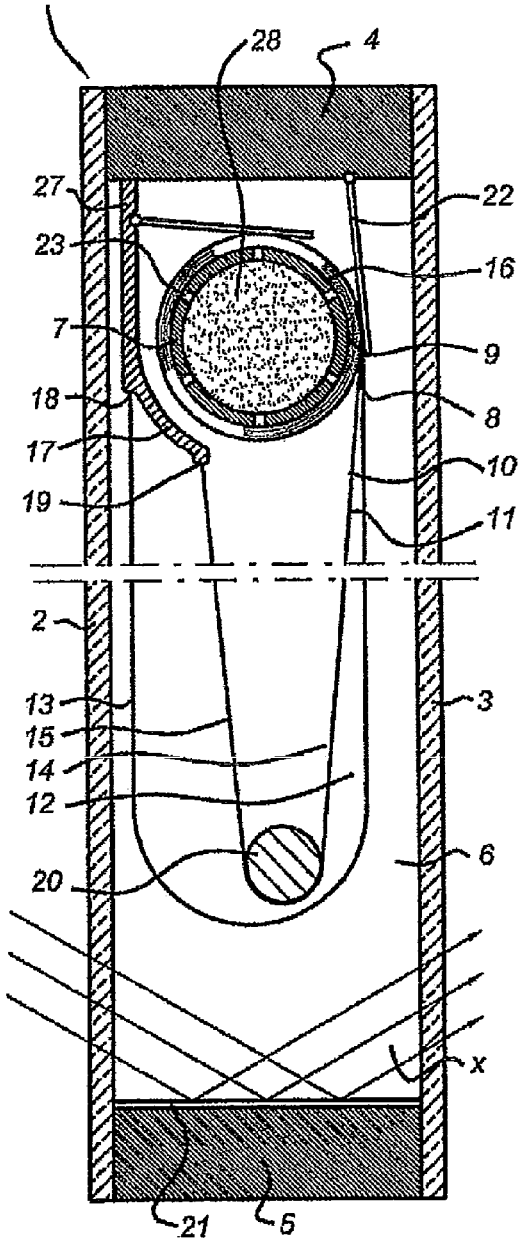
FIG. 2 shows a roller blind according to FIG. 1*a* in a partially lowered position.

Referring to FIG. 2, the lower edge 5 of the border of the glazing cavity 6 is advantageously provided with a reflective layer 21. Thus, as is indicated by arrows X, sunlight from outside can be reflected into the building via the lower edge 5, provided the roller blind is not completely unwound. Maintaining a gap in the vertical direction of 3 to 5 cm between the bottom side of the outer sheet 10 and the lower edge 5 is amply sufficient to ensure a good light yield inside the building under summary conditions. The amount of daylight reflected into the building may in this case result in a light yield of up to 500 lux (or even more). The slightly reduced insulation value and reflective properties as a result of the roller blind being raised in FIG. 2 are outweighed by far by the advantages of the increased light yield from daylight. Said daylight is regarded as being more pleasant than artificial light.

FIG. 2 furthermore shows that in a slightly raised position of the roller blind: a) the inner sheet 11 and the outer sheet 10 no longer hang parallel with one another as the attachment point 8 of the inner sheet on the winding reel has been moved so that it coincides with the release point 9 of the outer sheet; and b) the elongate body 20 has been moved to the right as a result of the attachment point 8 having been moved.

Figure 3:
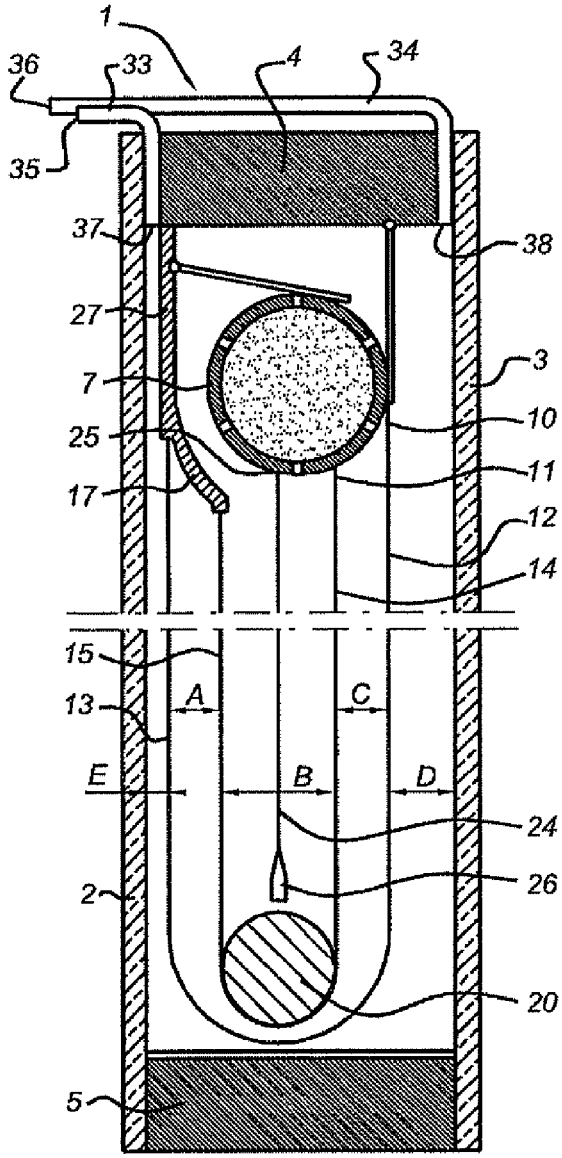
FIG. 3 shows a roller blind according to a further embodiment of the invention in the completely lowered position.

FIG. 3 shows further embodiments of the invention by way of illustration. Parts which are identical with those of the embodiment from FIG. 1 are here in each case indicated by the same reference numeral and will not be discussed in any more detail again.

On the one hand, the embodiment from FIG. 3 distinguishes itself by the fact that an additional single-layer sheet 24 is provided, the first width edge of which is attached to the winding reel 7 at 25 and the second width edge 26 of which, which runs parallel to the first width edge 25, is suspended freely in the space between the layers 14 and 15 of the inner sheet. Thus, the space between the layers 14 and 15 of the inner sheet 11 is divided into two vertical spaces, which further improves the heat-insulating effect as the gas layer in said space between the layers 14 and 15 is kept stationary more effectively.

On the other hand, the embodiment from FIG. 3 distinguishes itself by the fact that ventilation ducts 33 and 34 are provided. Said ventilation ducts are as such independent from the additional single-layer sheet 24 and prevent formation of condensation in the glazing cavity. These ventilation ducts are particularly advantageous if the glazing cavity has been created by means of a so-called secondary glazing unit, but can also be applied in an advantageous manner with a so-called double glazing unit (in which the inner pane and outer pane have already been combined to form a unit before the installation of the glazing unit).

Ventilation duct 33 has a first end 35 which ends outside the building and a second end 37 which ends in the space between the outer pane 2 and the outer layer 13 of the outer sheet 10. Ventilation duct 34 has a first end 36 which ends outside the building and a second end 38 which ends in the space between the inner pane 3 and the inner layer 12 of the outer sheet 10. The mouths of the first ends lie at a horizontal distance (i.e. viewed at right angles to the plane of the drawing in FIG. 3) of at least 1 to 2 cm.

If the ventilation ducts 33 and 34 end outside the building, the ventilation ducts operate as follows:

In cold weather, for example during the winter, the layer of air along the outer pane 2 is cold and therefore heaviest. Said air wants to sink. The layer of air along the inner pane 3 is warm and wants to rise. In winter, using the ventilation ducts, cold and therefore dry air will be supplied via the ventilation duct 33 on the side of the outer pane 2 and the hot and therefore moist air will be discharged via the ventilation duct 34 on the side of the inner pane 3. The cavity space then becomes "self-drying".

During sunny weather, for example in the summer, the effect is reversed. When the sun heats the outer layer 13 of the outer sheet 10, the latter will be dried by the heat. The air along the inner pane 3 is cool and sinks. The warm air along the outer pane 2 will want to rise and so there is then again a flow of air by means of which the hottest air with the highest vapour content will be discharged via the first ventilation duct 33.

Insects can be repelled by providing the ventilation ducts 33 and 34 with an insect screen or better still by providing dust filters. The latter will reduce the number of times the glass surfaces inside the glazing cavity have to be cleaned to approximately once every ten years.

Figure 4:
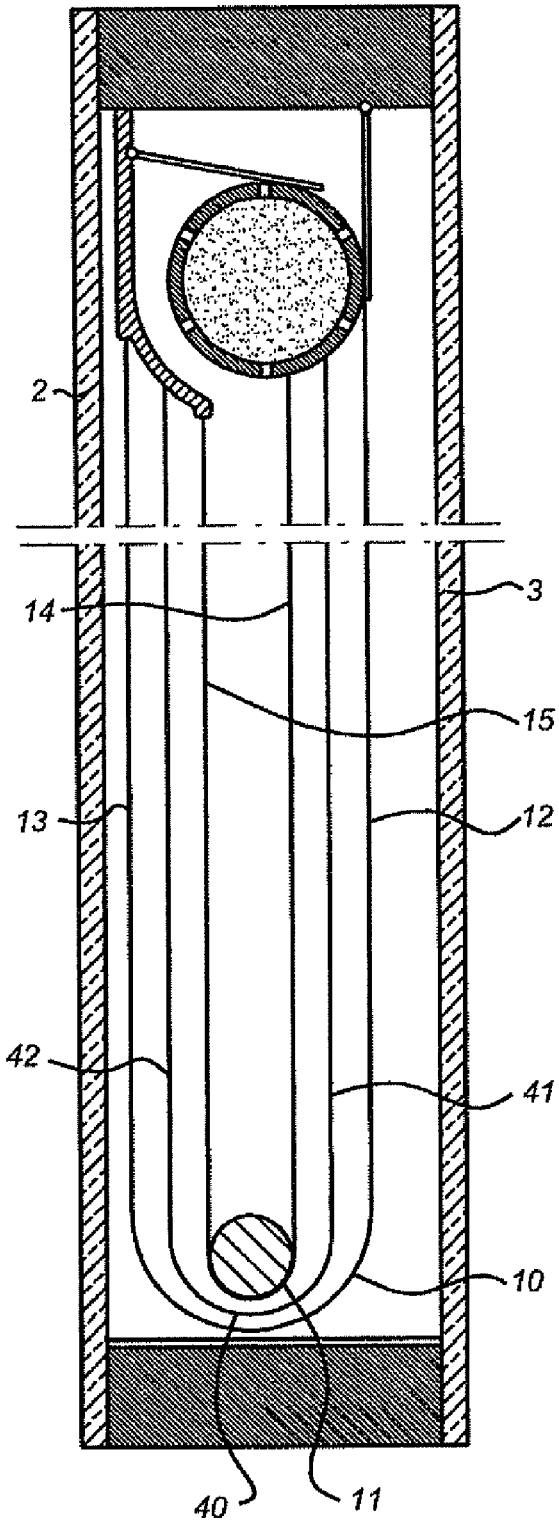
FIG. 4 shows a roller blind according to yet a further embodiment of the invention in the completely lowered position.

FIG. 4 shows a further variant of the roller blind according to the invention. In this variant, an intermediate sheet 40 is provided between the outer sheet 10 and inner sheet 11. Said intermediate sheet 40 has an outer layer 42 situated on the side of the outer pane 2 and an inner layer 41 which is situated on the side of the inner pane 3. As can be seen, the bending stiffness of the intermediate sheet 40 is, on the one hand, greater than the bending stiffness of the inner sheet 11 and, on the other hand, smaller than the bending stiffness of the outer sheet 10. The bending stiffness of the sheets 10, 11, 40 thus increases from the inner sheet 11 to the outer sheet 10.

Since, according to the present invention, the roller blind provides a plurality of vertical spaces which are separated from one another by the layers of the inner and outer sheet, the heat-insulating effect of the roller blind according to the invention is improved. This improved heat-insulating effect is improved still further by arranging the roller blind according to the invention in a glazing cavity which is screened off or closed off from the environment between two double glazing panes. This ensures that the air or the gas, which is present in the vertical spaces between the layers of the sheets is prevented as much as possible. As the air/gas is prevented as much as possible from moving, the transfer of heat is prevented to a large degree, which results in a good heat/cold-insulating effect. Said good insulating effect works under summary conditions to keep the heat generated by the sun out of the building and under wintery conditions to keep the heat generated by the heating system inside the building.

The invention claimed is:

1. A roller blind, comprising:

in a lowered position of the roller blind, four layers, with two outer layers of the four layers forming an outer sheet and two inner layers of the four layers forming an inner sheet;

an elongate body provided in the inner sheet in an unattached manner; and a winding reel attached to the inner sheet and outer sheet by a first width edge so that the inner and outer sheet can be unwound from the winding reel and wound onto the winding reel, wherein the inner sheet, at least in the lowered position of the roller blind, is positioned inside the outer sheet;

a bending stiffness of the inner sheet is such that a horizontal distance between the two inner layers of the inner sheet, at the elongate body, corresponds to a thickness of the elongate body, viewed in a horizontal direction;

the outer sheet is freely suspended with no added weight at the lower end of the two outer layers and has a bending stiffness which is greater than the bending stiffness of the inner sheet; and the bending stiffness of the outer sheet is such that the bending stiffness maintains a distance between the two outer layers of the outer sheet which is greater than the thickness of the elongate body when the outer sheet is freely suspended in such a manner that the two outer layers of the outer sheet are at a distance from the two inner layers of the inner sheet.

2. The roller blind according to claim 1, wherein the distance between the two outer layers of the outer sheet is approximately equal to or greater than a diameter of the winding reel.

3. The roller blind according to claim 1, wherein the outer and inner sheet each have a second width edge which runs parallel to the first width edge, the outer sheet and the inner sheet are each, at the second width edge, supported on a fixed supporting point, and the fixed supporting point of the outer sheet and the fixed supporting point of the inner sheet are at a horizontal distance from one another and, when the roller blind is completely unwound, viewed in the vertical direction, are higher than the elongate body.

4. The roller blind according to claim 1, further comprising one or more single-layer sheets attached to the winding reel by a first width edge and, in an unwound position, are suspended freely from a second width edge which runs parallel to the first width edge.

5. An assembly comprising:

a roller blind comprising, in a lowered position of the roller blind, four layers, with two outer layers of the four layers forming an outer sheet and two inner layers of the four layers forming an inner sheet;

an elongate body provided in the inner sheet in an unattached manner; and a winding reel attached to the inner sheet and outer sheet by a first width edge so that the inner and outer sheet can be unwound from the winding reel and wound onto the winding reel, wherein the inner sheet, at least in the lowered position of the roller blind, is positioned inside the outer sheet;

a bending stiffness of the inner sheet is such that a horizontal distance between the two inner layers of the inner sheet, at the elongate body, corresponds to a thickness of the elongate body, viewed in a horizontal direction;

the outer sheet is freely suspended with no added weight at the lower end of the two outer layers and has a bending stiffness which is greater than the bending stiffness of the inner sheet; and the bending stiffness of the outer sheet is such that the bending stiffness maintains a distance between the two outer layers of the outer sheet which is greater than the thickness of the elongate body when the outer sheet is freely suspended in such a manner that the two outer layers of the outer sheet are at a distance from the two inner layers of the inner sheet; and a double glazing unit which defines a glazing cavity, wherein the roller blind is provided inside the glazing cavity.

6. The assembly according to claim 5, wherein a motor is provided for driving the winding reel, and is accommodated in the glazing unit.

7. The assembly according to claim 5, wherein a lower edge of a border of the glazing cavity is provided with a reflective surface turned towards the glazing cavity.

8. The assembly according to claim 5, wherein second width edges of the inner and outer sheets which, in an unwound position, each have two layers, and the winding reel are provided along an upper edge of the double glazing unit, and one or more flaps are provided along the upper edge of the double glazing unit which prevent the flow of air along an upper side of the winding reel.

9. The assembly according to claim 5, wherein an upper edge of the glazing cavity is provided with a first ventilation duct and a second ventilation duct; outer ends of both ventilation ducts ending outside the assembly; an inner end of the first ventilation duct ending in a space between the outer pane and an outer layer of the outer sheet; and an inner end of the second ventilation duct ending in the space between the inner pane and an inner layer of the outer sheet.

* * * * *